US005818017A

United States Patent [19]

Ye et al.

[11] Patent Number: 5,818,017

[45] Date of Patent: Oct. 6, 1998

[54] MICROWAVE OVEN MAIN BODY STRUCTURE

[75] Inventors: Jin Hae Ye; Jong Wook Lee, both of Kyungsangnam-Do, Rep. of Korea

[73] Assignee: LG Electronics Inc., Rep. of Korea

[21] Appl. No.: 593,250

[22] Filed: Jan. 29, 1996

[30] Foreign Application Priority Data

May 16, 1995 [KR] Rep. of Korea ..... 1995-10341
May 16, 1995 [KR] Rep. of Korea ..... 1995-12077

[51] Int. Cl.[6] ..... H05B 6/80

[52] U.S. Cl. ..... 219/756; 126/273 R

[58] Field of Search ..... 219/756, 757, 219/738; 312/236; 126/273 R

[56] References Cited

U.S. PATENT DOCUMENTS 4,609,801 9/1986 Spencer et al. ..... 219/756
4,788,395 11/1988 Sakoda ..... 219/756
4,843,204 6/1989 Ueno ..... 219/756

FOREIGN PATENT DOCUMENTS 0301575 2/1989 European Pat. Off. .
0394978 10/1990 European Pat. Off. .
60-245930 12/1985 Japan ..... 219/756
60-263018 12/1985 Japan ..... 219/756
60-263024 12/1985 Japan ..... 219/756
61-6516 1/1986 Japan ..... 219/756

*Primary Examiner*—Philip H. Leung
*Attorney, Agent, or Firm*—Ostrolenk, Faber, Gerb & Soffen, LLP

[57] ABSTRACT

An improved microwave oven main body structure capable of more easily assembling an outer plate and an inner plate of the main body by providing a support member to the outer plate, so that the support member is engaged with the outer plate of the main body, which includes an outer plate having a bottom wall, a front wall, and a rear wall; a support member formed on the bottom of the outer plate; and a front- and rear-portion-opened inner plate engaged to the interior of the outer plate and having an outwardly extended side wall; wherein the lower surface of a flange formed at the lower portion of the side wall of the inner plate which is downwardly extended contacts with the upper surface of the bottom of the outer plate.

3 Claims, 12 Drawing Sheets

MICROWAVE OVEN MAIN BODY STRUCTURE

BACKGROUND OF THE INVENTION

1. Field of the Invention

The present invention relates to a microwave oven main body structure, and in particular to an improved microwave oven main body structure capable of more easily assembling an outer plate and an inner plate of the main body by forming a support member at the outer plate, so that the support member is engaged with the outer plate of the main body.

2. Description of the Conventional Art

Recently, a cavity of a microwave oven consists of two pieces of an outer plate and an inner plate so as to increase productivity of the microwave oven in the industry.

FIG. 1 shows a conventional microwave oven main body structure, which includes an outer plate which includes a front wall 3 and a rear wall 4.

In addition, an inner plate 10, as shown in FIG. 2, includes side walls 12 formed about an upper wall 11.

An upper flange 11*a* is formed along the rim of the upper wall 11, and a side flange 12*a* is formed at the side of the side walls 12, and a lower flange 12*b* is formed at the lower surface of the side walls 12.

Each of flanges 11*a*, 12*a*, and 12*b* includes spaced-apart embossing protrusions formed at the outer portion thereof.

The process of assembling the outer plate 1 and the inner plate 10 will now be explained.

To begin with, the inner plate 10 is fit to the outer plate 1.

At this time, in a state that the front wall 3 of the outer plate 1 and the inner surface of the rear wall 4 contacts with the both sides of the flange 12*a* of the inner plate 10, the embossing protrusions of the both sides of the flange 12*a* is fixed to the inner side of the front wall 3 and the rear wall 4 of the outer plate 1 in the projection welding method, so that the inner plate 10 is engaged to the outer plate 1.

In addition, the lower flange 12*b* formed at a bottom wall of the outer plate 1 and the side walls of the inner plate 10 are assembled in the projection welding method or other welding methods, so that a component compartment 5 of the outer plate 1 and a door engaging section 6 are reinforced.

Although this conventional microwave oven main body structure has advantages in that the component compartment 5 of the outer plate 1 and the door engaging section 6 are reinforced by permitting the bottom wall 2 of the outer plate 1 and the lower flanges 12*b* of the inner plate 10 to be engaged with each other, since a lower contact section 3*a*, as shown in FIG. 3, is formed at the front wall 3 of the outer plate 1 so as to prevent microwave leakages between the front wall 3 of the outer plate 1 and the door (not shown), a certain recess having the height "h" is provided between the lower contact section 3*a* of the outer plate 1 and the bottom wall 2, it is difficult to clean the interior of the microwave oven.

FIGS. 4 and 5 show another conventional microwave oven main body structure, which includes a front wall 32 and a rear wall 33 disposed at the front and rear sides of a bottom wall 31 of the outer plate 30, respectively.

In addition, the bottom wall 31 of the outer plate 30 includes an opening 34 for receiving components.

In addition, the inner plate 40 is three time curved and both ends thereof meet to each other.

Flanges 41*a*, 42*a*, 43*a*, and 44*a* are formed at the front and rear rims of an upper wall 41, a lower wall 42, a left side wall 43, and a right side wall 44, respectively.

A plurality of spaced-apart embossing protrusions (not shown) are formed at the outer side of the flanges 41*a*, 42*a*, 43*a*, and 44*a*.

The process of assembling the outer plate 30 and the inner plate 40 of another conventional embodiment will now be explained.

The inner plate 40 is engaged to the interior of the outer plate 30.

At this time, in a state that the flanges 41*a*, 42*a*, 43*a*, and 44*a* of the inner plate 40 contact with the inner side of the front wall 32 and the rear wall 33 of the outer plate 30, the embossing protrusion of the flanges 41*a*, 42*a*, 43*a*, and 44*a* are fixed to the inner side of the front plate 32 and the rear wall 33 of the outer plate 30, so that the outer plate 30 and the inner plate 40 are engaged with each other in the projection welding method and the like.

In addition, a cover 35 is engaged to the lower portion of the outer plate 30 so as to block the openings 34 formed at the outer plate 30.

Although this conventional microwave oven main body structure has advantage in that the problem of the recess can be resolved, since the opening 34 is formed at the bottom wall 31 of the outer plate 30, when relatively heavy components are disposed in the system, the component compartment 36 and the door engaging section 37 can be easily deformed due to the over weight thereof.

In this regard, a reinforcing member must be additionally provided so as to support the frame.

FIGS. 6 through 8 show another conventional microwave oven main body structure, which includes an inner plate 52 which is three times curved at 90°.

A curling section 54*a* is formed at the entire front rim portion of the inner plate 52, and a flange section 53*a* is formed at the entire rear rim portion of the inner plate 52.

A plurality of spaced-apart embossing protrusions 53*b* are formed at the flange 53*a* of the side walls 53 of the inner plate 52.

In addition, a window section 59 is formed at the front wall 55 of the outer plate 51 which is twice curved at 90°.

A curling section 55*a* is formed at the inner surface of the outer plate 51, that is, at a periphery of the window section 59 opposed to the curling 54*a* of the inner plate 52.

In addition, a plurality of engaging openings 56*a* are formed at the inner wall of the rear wall 56 opposing to the flange 53*a* of the inner plate 52.

Therefore, the front portion of the curling section 54*a* of the inner plate 52 is engaged to the front portion of the curling section 55*a* of the outer plate 51.

In addition, the rear portion of the flange 53*a* of the inner plate 52 is fixed to the rear wall 56 of the outer plate 51 in the calking method.

That is, as shown in FIGS. 8A through 8C, the flange 53*a* of the inner plate 52 is fit to the rear wall 56 of the outer plate 51, and each of the embossing protrusions 53*b* of the inner plate 52 is fit to the interior of the engaging opening 51*b* of the outer plate 51, so that the embossing protrusions 53*b* are deformed by hitting using a puncher P the embossing protrusions 53*b* which passed through the engaging opening 56*a* of the outer plate 51, and the inner plate 52 is fixed to the outer plate 51.

At this time, a certain space S is formed between the bottom 58 of the outer plate 51 and the bottom 54 of the inner plate 52.

However, in this conventional microwave oven main body structure, since the certain space S is formed between the bottom 58 of the outer plate 51 and the bottom 54 of the inner plate 52 without any supporting member therebetween, the microwave oven main body can be easily deformed, and it is difficult to curl for forming the curling section 55*a* at the front lower portion of the outer plate 51.

Moreover, when calking the outer plate 51 and the inner plate 52, and an engaging process between the engaging opening 56*a* of the outer plate 51 and the embossing protrusions 53*b* of the inner plate 52 are accurately performed, it is impossible to fix the outer plate 51 and the inner plate 52. As a result, the deformation process between the engaging opening 56*a* of the outer plate 51 and the embossing protrusions 53*b* of the inner plate 52 must be performed again, thus decreasing productivity.

SUMMARY OF THE INVENTION

Accordingly, it is an object of the present invention to provide a microwave oven main body structure, which overcome the problems encountered in a conventional microwave oven main body structure.

It is another object of the present invention to provide an improved microwave oven main body structure capable of more easily assembling an outer plate and an inner plate of the main body by forming a support member at the outer plate, so that the support member is engaged with the outer plate of the main body.

To achieve the above objects, in accordance with a first embodiment of the present invention, there is provided a microwave oven main body structure, which includes an outer plate having a bottom wall, a front wall, and a rear wall; a support member formed on the bottom of the outer plate; and a front- and rear-portion-opened inner plate engaged to the interior of the outer plate and having an outwardly extended side wall; wherein the lower surface of a flange formed at the lower portion of the side wall of the inner plate which is downwardly extended contacts with the upper surface of the bottom of the outer plate.

To achieve the above objects, in accordance with a second embodiment of the present invention, there is provided a microwave oven main body structure, which includes an outer plate having a bottom wall, a front wall, and a rear wall; a plurality of support members formed at the bottom of the outer plate; and an inner plate fixed to the interior of the outer plate and having outwardly extended both ends formed at a contact portion of side walls.

DETAILED DESCRIPTION OF THE INVENTION

Figure 1:
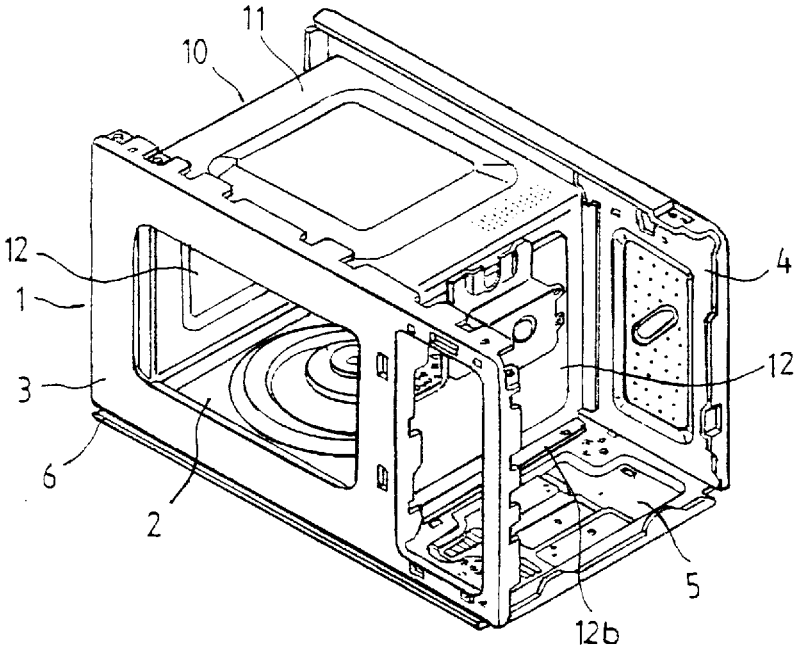
FIG. 1 CONVENTIONAL ART
FIG. 1 is a perspective view showing a conventional microwave oven main body structure.
Figure 2:
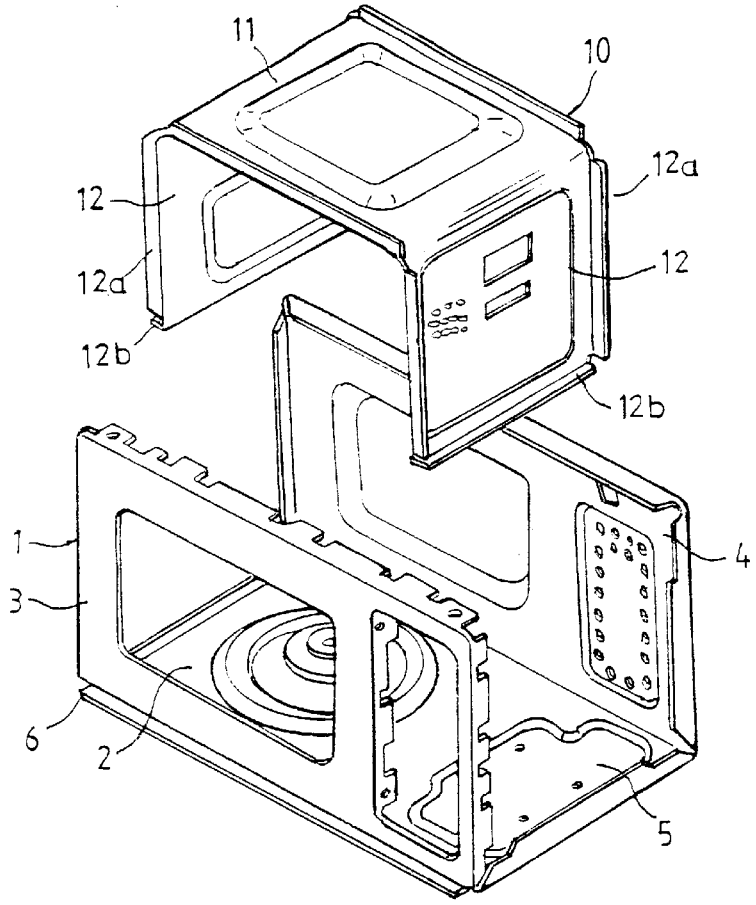
FIG. 2 CONVENTIONAL ART
FIG. 2 is an exploded perspective view showing a conventional microwave oven main body structure of FIG. 1.
Figure 3:
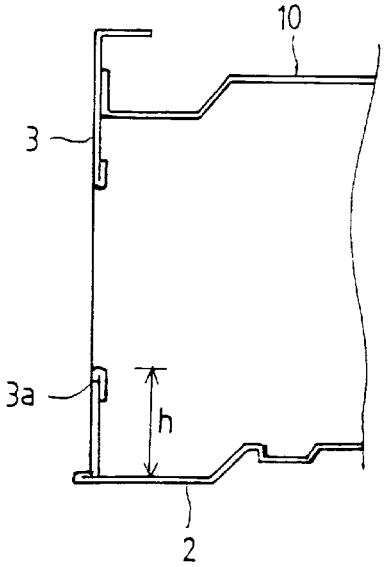
FIG. 3 CONVENTIONAL ART
FIG. 3 is a partial side cross-sectional view of a conventional microwave oven main body structure.
Figure 4:
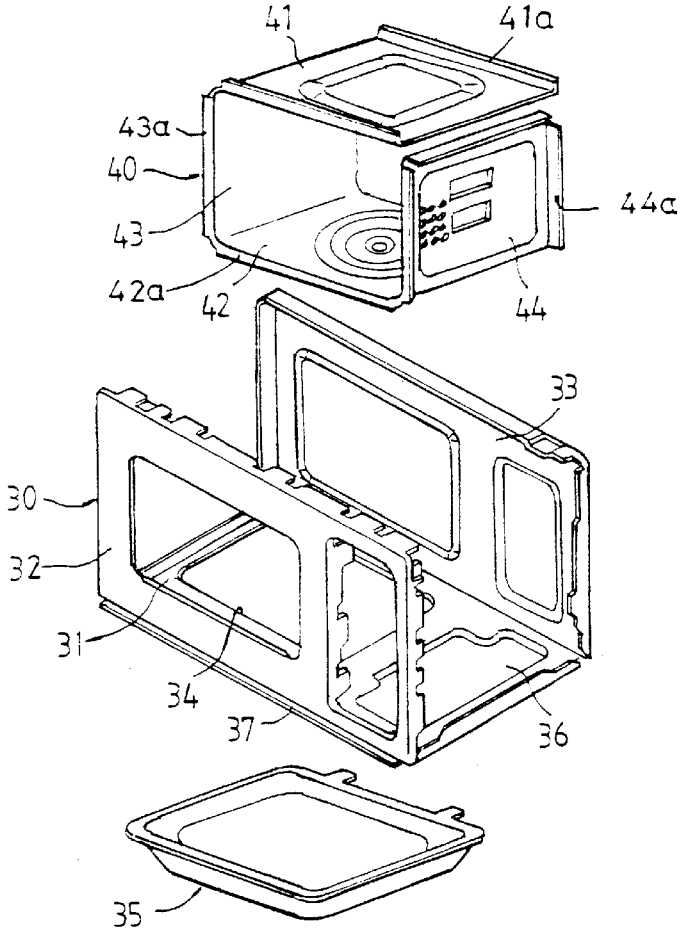
FIG. 4 CONVENTIONAL ART
FIG. 4 is an exploded perspective view showing another conventional microwave oven main body structure.
Figure 5:
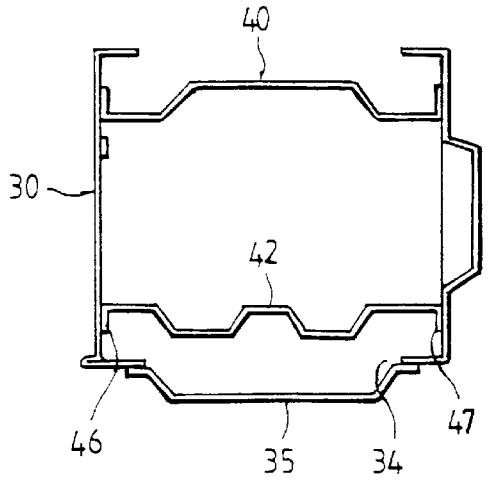
FIG. 5 CONVENTIONAL ART
FIG. 5 is a side cross-sectional view of a conventional microwave oven main body structure of FIG. 4.
Figure 6:
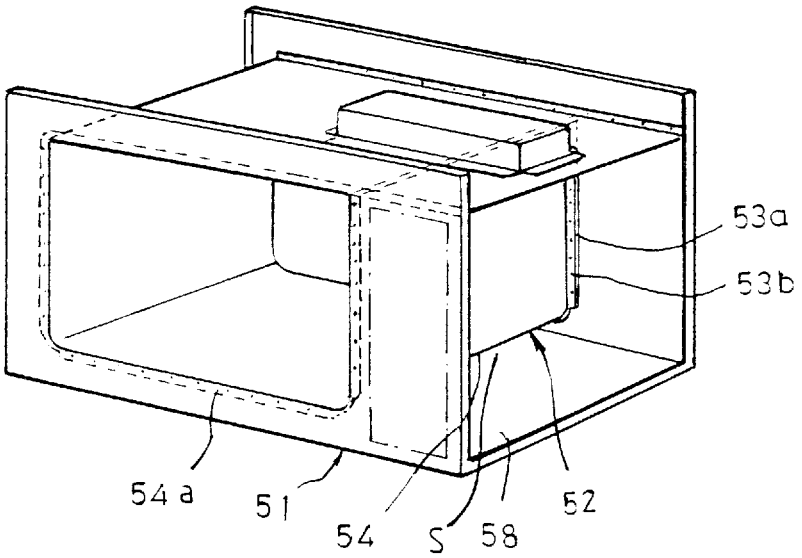
FIG. 6 CONVENTIONAL ART
FIG. 6 is a perspective view showing another conventional microwave oven main body structure.
Figure 7:
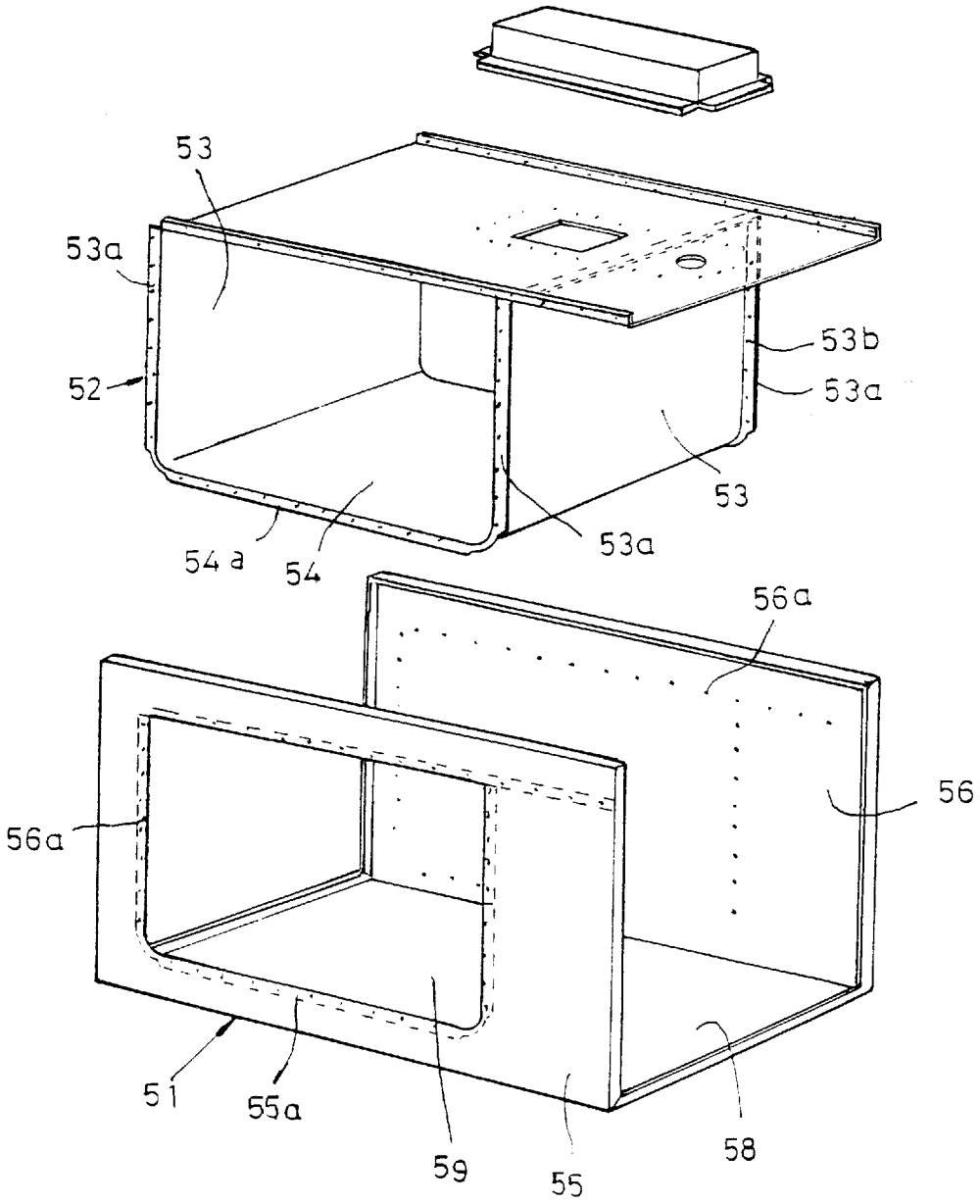
FIG. 7 CONVENTIONAL ART
FIG. 7 is an exploded perspective view showing another conventional microwave oven main body structure.
Figure 8A:
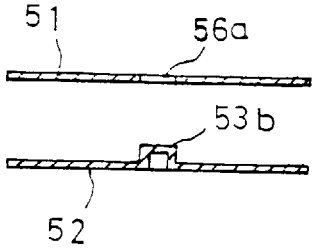
FIG. 8A CONVENTIONAL ART
FIG. 8A is a cross-sectional view of an outer plate and an inner plate of a cavity before the outer and inner plate are assembled of another conventional microwave oven main body structure.
Figure 8B:
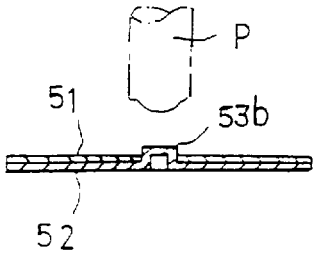
FIG. 8B CONVENTIONAL ART
FIG. 8B is a cross-sectional view of an outer plate and an inner plate before the outer and inner plates of a cavity are calked in another conventional microwave oven main body structure.
Figure 8C:
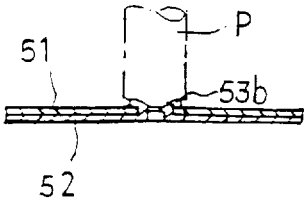
FIG. 8C CONVENTIONAL ART
FIG. 8C is a cross-sectional view of an outer plate and an inner plate after the outer and inner plates of a cavity are calked in another conventional microwave oven main body structure.
Figure 9:
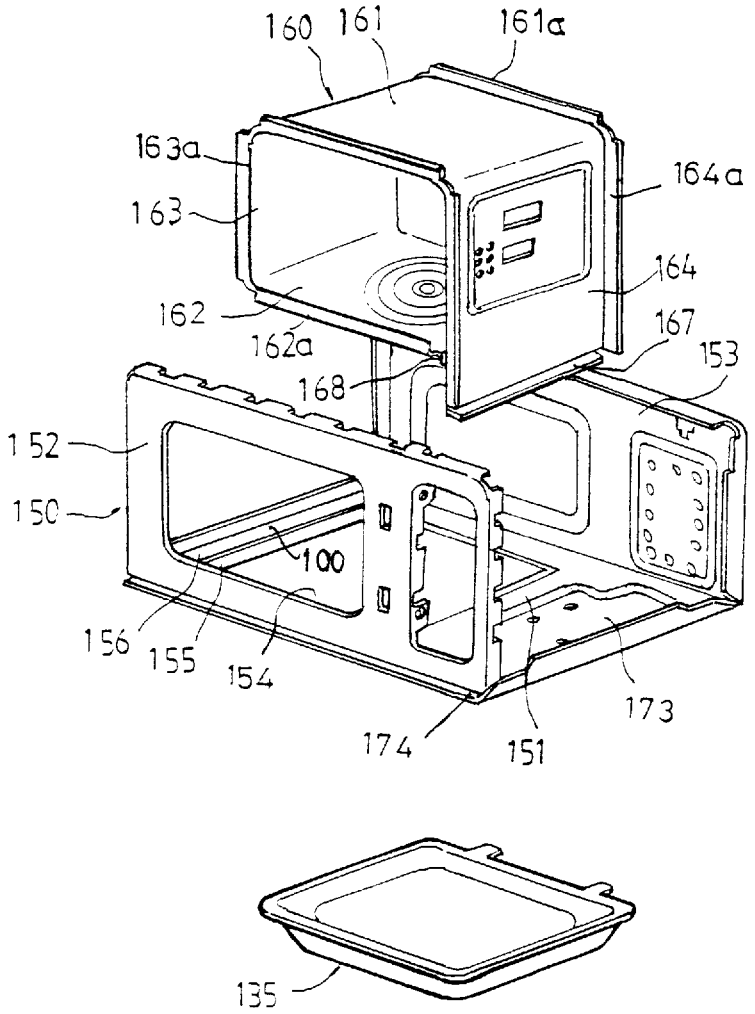
FIG. 9 is an exploded perspective view showing a microwave oven main body structure of a first embodiment according to the present invention.

FIG. 9 shows a microwave oven main body structure of a first embodiment according to the present invention, which includes an inner plate 160 which is curved three times at 90°.

Flanges 161*a*, 162*a*, 163*a*, and 164*a* are formed at the entire front and rear rims of an upper wall 161, a lower wall 162, a left side wall 163, and a right side wall 164 of the inner plate 160.

Meanwhile, a front wall 152 and a rear wall 153 are formed at the bottom 151 of the outer plate 150, and a support member 100 is disposed at one side of the bottom 151.

Figure 10:
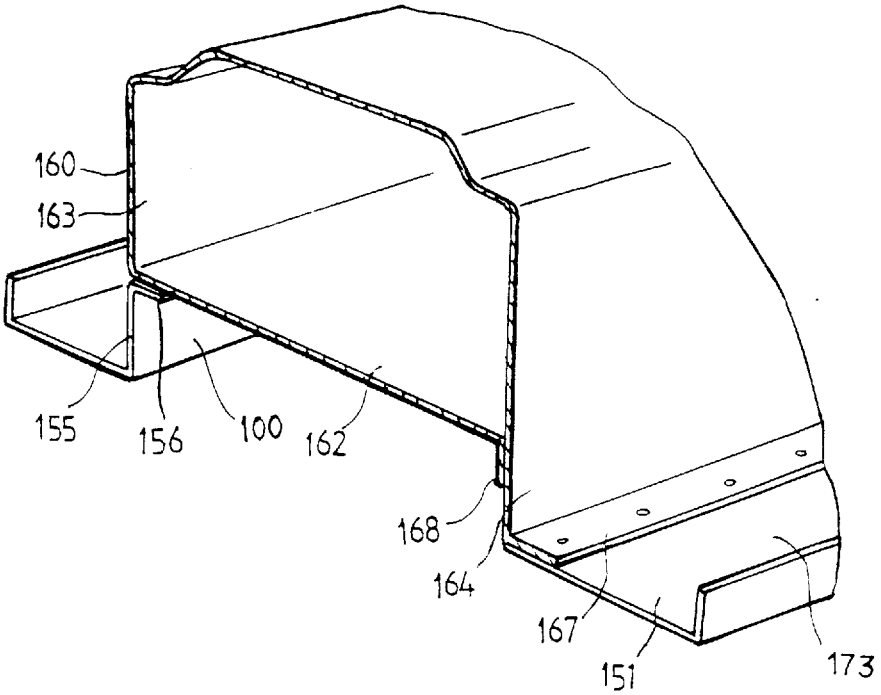
FIG. 10 is a partial perspective view showing an engaging portion of a microwave oven main body structure of a first embodiment according to the present invention.

As shown in FIGS. 9 and 10, the support member 100 includes a vertical support wall 155 formed at one side of an opening 154 in the front and rear directions of the microwave oven main body, and a horizontal support wall 156 which is formed at the upper portion of the vertical support wall 155 and curved in the direction of the interior of the microwave oven main body.

Part of the bottom of the inner plate 160 contacts with the upper surface of the horizontal support wall 156.

Meanwhile, the side wall 164 of the inner plate 160 which is not supported by the support member 100 of the outer plate 150 is downwardly extended to come into contact with the bottom 151 of the outer plate 150.

A flange 167 is formed at one side of the lower plate 162 of the inner plate 160 and is welded to a predetermined inner portion of the side wall 164 of the inner plate 160.

In the drawings, reference numeral 173 denotes a component compartment.

The process of assembling the outer plate 150 and the inner plate 160 of the microwave oven main body of a first embodiment according to the present invention will now be explained with reference to the accompanying drawings.

To begin with, the flange 168 formed at the recess of the lower wall 162 of the inner plate 160 is fixed to the inner surface of the side wall 164 of the inner plate 160 in the projection welding method or the like.

Thereafter, as shown in FIG. 10, the inner plate 160 is introduced into the interior of the outer plate 150. In a state that the lower side of the lower wall 162 of the inner plate 160 is supported to the upper surface of the horizontal support plate 156 formed at the outer plate 150, as shown in FIG. 9, the flanges 161*a*, 162*a*, 163*a*, and 164*a* of the inner plate 160 contact with the inner surface of the front wall 152 and the rear wall 153 of the outer plate 150, and the inner plate 160 is fixed to the outer plate 150 in the projection welding method or the like.

The upper surface of the bottom wall 151 of the outer plate 150 and the lower surface of the flange 167 formed at the lower portion of the side wall 164 of the inner plate 160 contact with each other, and welded in the projection welding method or the like, so that a microwave oven cavity is fabricated.

At this time, since the opening 154 is formed at the bottom wall 151 of the outer plate 150, it is possible to more easily assemble the inner plate 160 and the outer plate 150 in cooperation with the opening 154.

In addition, a cover 135 is engaged to the bottom of the outer plate 150 so as to cover the opening 154 formed at the outer plate 150.

Figure 11:
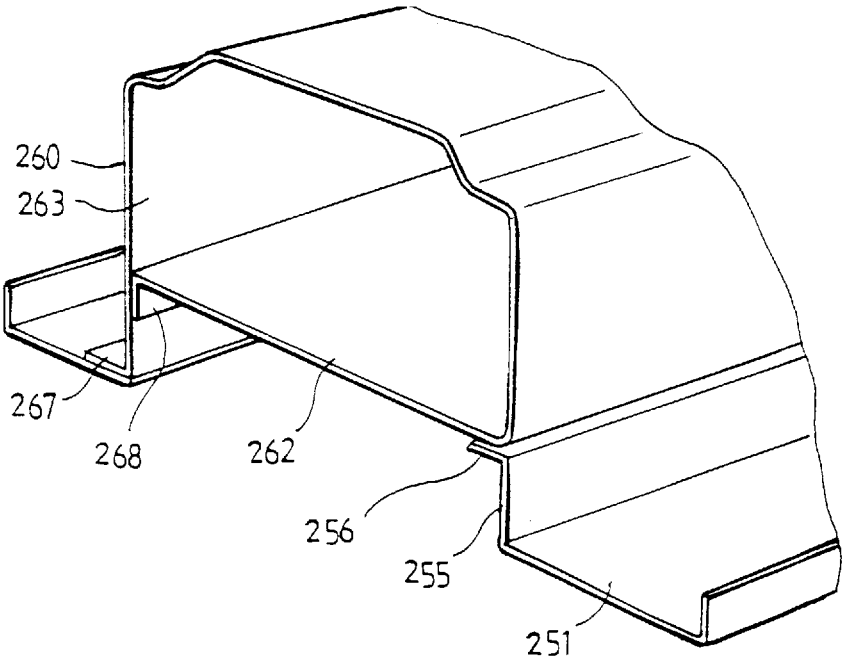
FIG. 11 is a partial perspective view showing a microwave oven main body structure of a second embodiment according to the present invention.

Meanwhile, FIG. 11 shows a microwave oven main body structure of a second embodiment according to the present invention, which is directed to exchanging the positions of the support member formed on the bottom wall 251 of the outer plate 150 and the position in which the inner plate 260 is fixed to the outer plate 150 of the first embodiment according to the present invention.

Figure 12:
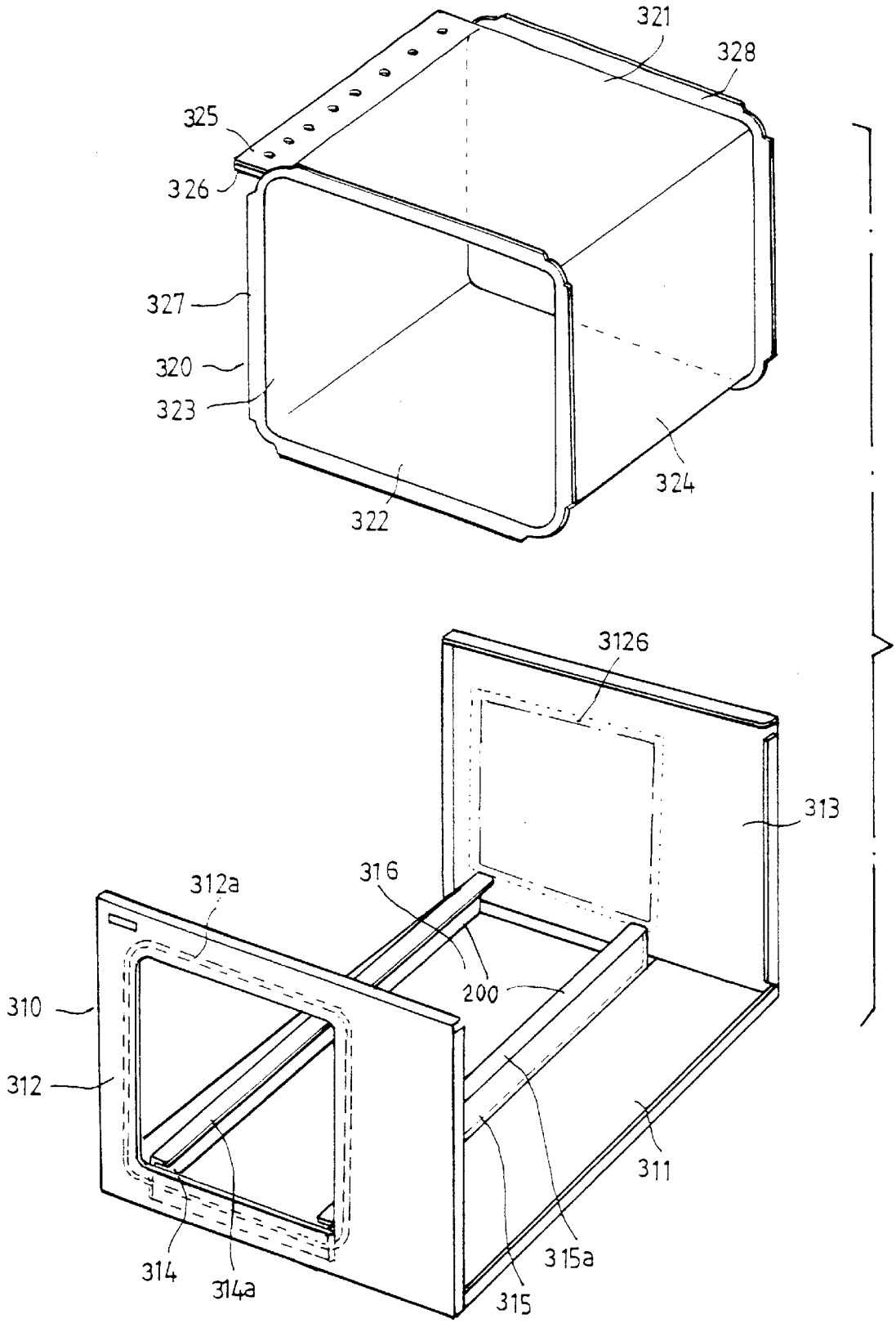
FIG. 12 is an exploded perspective view showing a microwave oven main body structure of a third embodiment according to the present invention.

Next, FIG. 12 shows a microwave oven main body structure of a third embodiment according to the present invention, which is directed to calking and curing an outer plate 310 and an inner plate 320 for engaging the outer plate 310 and the inner plate 320 and provides a plurality of support members 200 at a front portion and a rear portion of a bottom wall 311 of the outer plate 310 so as to reinforce the inner plate 320 with respect to the outer plate 310.

In addition, in this embodiment of the present invention, it is possible to more easily curl the outer plate 310 and the inner plate 320. That is, this embodiment is directed to calking in a surface-to-surface state, as compared to the previous embodiment of the present invention which is characterized to calking in a rugged state between the outer plate 310 and the inner plate 320, so that a more accurate engagement between the outer plate 310 and the inner plate 320 can be achieved.

In more detail, the front- and rear-portion-opened inner plate 320 is curved three times at 90° and includes an upper wall 321, a lower wall 322, a left side wall 323, and a right side wall 324.

In addition, the contacting portion between the upper wall 321 of the inner plate 320 and the left side wall of the same includes end sections 325 and 326 extended outwardly by a predetermined length and calk-fixed to each other.

In addition, flanges 327 and 328 are formed at the entire portion of the front and rear portion rims of the upper wall 320, the upper wall 321, the lower wall 322, the left side wall 323, and the right side wall 324 of the inner plate 320.

Meanwhile, a front wall 312 and a rear wall 313 are formed at the bottom 311 of the outer plate 310, and a support member 200 is formed at both sides of the bottom 311.

The support member 200 of the third embodiment according to the present invention includes vertical support walls 314 and 315 spaced-apart in the directions of the front and rear portion of the microwave oven main body wherein the bottom surface 311 of the outer plate 310 is bent, and horizontal support walls 314*a* and 315*a* each inwardly curved in the direction of the interior of the microwave oven main body at the upper portion of the vertical support walls 314 and 315.

In addition, there is formed an opening 316 on the bottom of the outer plate 310 between the vertical support walls 314 and 315 for an easier curling work, and a curling section 312*a* is formed at the inner surface of the front wall 312 of the outer plate 310 so that it is engaged to the flange 327 of the inner plate 320.

Figure 13A:
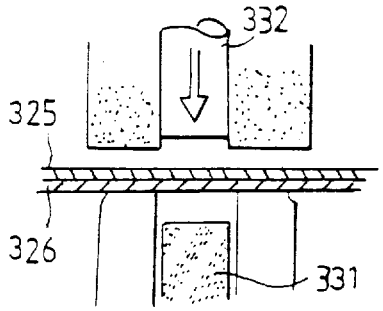
FIG. 13A is a cross-sectional view showing an inner plate when both ends thereof contacts with each other of a microwave oven main body structure of a third embodiment according to the present invention.
Figure 13B:
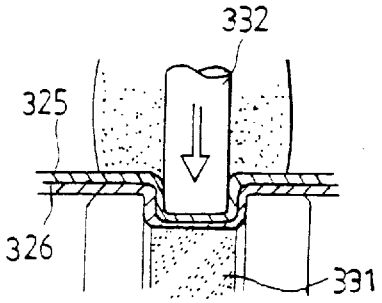
FIG. 13B is a cross-sectional view so as to show a calking process of both ends of an inner plate of a microwave oven main body structure of a third embodiment according to the present invention.
Figure 13C:
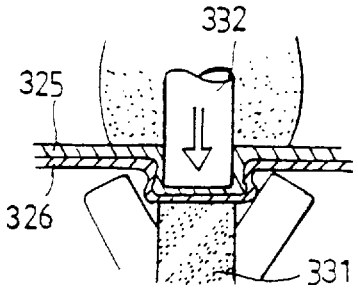
FIG. 13C is a cross-sectional view so as to show a construction that both ends of an inner plate is plastic-deformed in a microwave oven main body structure of a third embodiment according to the present invention.

The calking for fixing the end portions 325 and 326 of the inner plate 320, as shown in FIGS. 13A through 13C, the end portions 325 and 326 of the upper wall 321 and the lower wall 323 of the inner plate 320 are fit to each other and put on a die 331.

Figure 14:
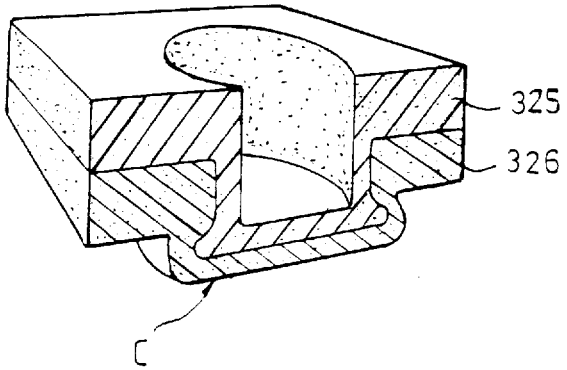
FIG. 14 is a perspective view showing a calked portion of a cavity of a microwave oven main body of a third embodiment according to the present invention.

In the above-mentioned state, when hitting the end portions 325 and 326 of the upper wall 321 and the lower wall 323 of the inner plate 320 using a punch 332, as shown in FIG. 14, the calking section S is deformed, and the hitting is repeatedly performed, and the end portions 325 and 326 are fixed to each other.

Figure 15:
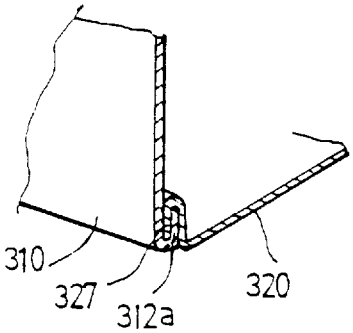
FIG. 15 is a perspective view showing a curling structure of a cavity of a microwave oven main body structure of a third embodiment according to the present invention.

In addition, in a state that both sides of the lower portion of the lower wall 322 of the inner plate 320 contacts with the upper surface of the horizontal support wall 314*a* and 315*a* formed at both sides of the bottom plate 311 of the outer plate 310, the curling section 312*a* of the outer plate 310 and the front flange 327 of the inner plate 320 are curled as shown in FIG. 15.

In addition, the flange 328 of the inner plate 320 and the rear wall 313 of the outer plate 310 are calked and welded.

Therefore, the horizontal support walls 314*a* and 315*a* formed at the outer plate 310 and the periphery of the lower portion of the lower wall 322 of the inner plate 320 stably contact with each other, thus reinforcing the main body.

Figure 16:
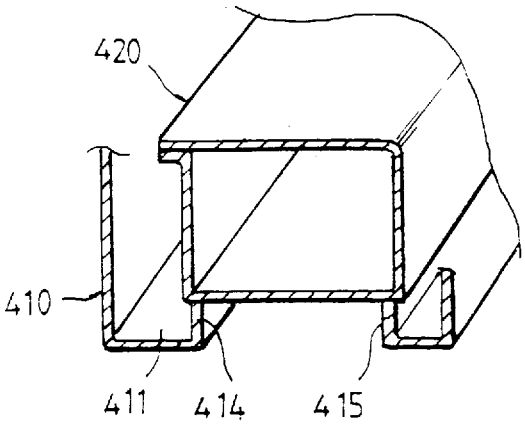
FIG. 16 is a perspective view showing a microwave oven main body structure of a fourth embodiment according to the present invention.

Meanwhile, FIG. 16 shows a microwave oven main body structure of a fourth embodiment according to the present invention, which includes vertical support walls 414 and 415 formed at both sides of the bottom 411 of the outer plate 410 for supporting the inner plate 420.

Figure 17:
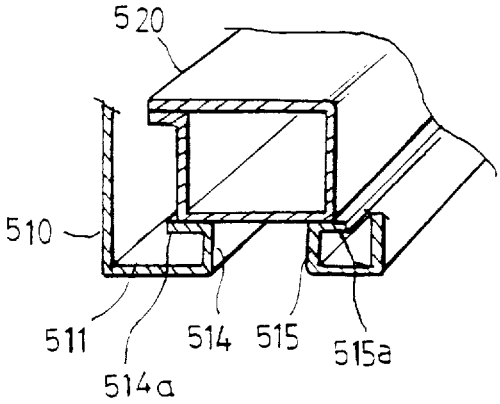
FIG. 17 is a perspective cross-sectional view showing a microwave oven main body structure of a fifth embodiment according to the present invention.

Next, FIG. 17 shows a microwave oven main body structure of a fifth embodiment according to the present invention, which includes vertical support walls 514 and 515 at both ends of the bottom 511 of the outer plate 510, and horizontal support walls 514*a* and 515*a* formed at the upper portion of the vertical support walls 514 and 515. Here, the horizontal support walls 514*a* and 515*a* are curved outwardly so as to support the inner plate 520.

As described above, the microwave oven main body structure according to the present invention is directed to reinforcing the component compartment and the door engaging section of the outer plate without using an additional reinforcing member by forming a support member at one side of the bottom of the outer plate so as to support the inner plate, extending downwardly the side wall of the inner plate which is not supported by the support member so that the side wall thereof can contact with the bottom wall of the outer plate, thus preventing a recess formation in the microwave oven main body.

In addition, the present invention is further directed to improving the strength of the product by forming a plurality of support members at the bottom of the outer plate for supporting the inner plate so that the bottom of the inner plate can be supported by the support members. Moreover, a more stable engagement between the outer plate and the inner plate can be achieved by a deformation at the calking portion by calking the outer plate and the inner plate.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A microwave oven main body structure, comprising:

an outer housing formed of a single plate and bent to form a bottom wall, a front wall, and a rear wall;

support means formed on said bottom wall of said outer housing; and an inner housing formed of a single plate and bent to form a rectangular chamber defining a top wall, a bottom wall, a right side wall and a left side wall, the rectangular chamber having opened front and rear portions thereof, the opened front and rear portions being attached to the front wall and to the rear wall of the outer housing, respectively, wherein the right side wall of the rectangular chamber is attached to the bottom wall of the outer housing, and the left side wall of the rectangular chamber is supported by the support means formed on the bottom wall of the outer housing, and wherein said bottom wall of the outer housing includes an opening formed at an intermediate portion thereof.

2. The structure of claim 1, wherein said support means includes:

a vertical support wall having a flange extending therefrom, the flange being attached to the bottom wall of the outer housing; and a horizontal support wall attached to the vertical support wall and connected to the bottom wall of the rectangular chamber.

3. The structure of claim 2, wherein said vertical support wall and said horizontal support wall are formed at a periphery of the opening on the bottom wall of the outer housing.

* * * * *